US007753609B2

(12) United States Patent
Bouix et al.

(10) Patent No.: US 7,753,609 B2
(45) Date of Patent: Jul. 13, 2010

(54) COSMETIC APPLICATORS CONTAINING HEATING ELEMENTS

(75) Inventors: Herve Bouix, New York, NY (US); Christophe Jacob, Rouen (FR)

(73) Assignee: ELC Management LLC, New York, NY (US)

( * ) Notice: Subject to any disclaimer, the term of this patent is extended or adjusted under 35 U.S.C. 154(b) by 986 days.

(21) Appl. No.: 11/422,729

(22) Filed: Jun. 7, 2006

(65) Prior Publication Data

US 2007/0286665 A1 Dec. 13, 2007

(51) Int. Cl.
*A46B 11/00* (2006.01)
*A46B 11/08* (2006.01)

(52) U.S. Cl. ..... 401/129; 401/126; 401/122; 401/1

(58) Field of Classification Search ..... 401/1, 401/2, 126, 128–130, 121, 122; 132/218, 132/318, 320

See application file for complete search history.

(56) References Cited

U.S. PATENT DOCUMENTS

| | | | | |
|---|---|---|---|---|
| 4,329,567 | A | 5/1982 | Kunz et al. | |
| 4,538,630 | A | 9/1985 | Henderson | |
| 4,733,784 | A | 3/1988 | Bennett | |
| 5,096,319 | A | 3/1992 | Gueret | |
| 5,775,344 | A | 7/1998 | Clay | |
| 5,853,010 | A | 12/1998 | Suh | |
| 5,911,226 | A | 6/1999 | Vecchiola et al. | |
| 6,009,884 | A | 1/2000 | Suh | |
| 7,083,347 | B2 * | 8/2006 | Marcotte et al. | 401/1 |
| 7,090,420 | B2 | 8/2006 | De La Poterie et al. | |
| 7,108,438 | B2 | 9/2006 | Fontaine | |
| 7,322,366 | B2 | 1/2008 | Cho | |
| 7,465,114 | B2 * | 12/2008 | Kress et al. | 401/129 |
| 7,669,605 | B2 | 3/2010 | Cho | |
| 2004/0096258 | A1 | 5/2004 | Kim | |
| 2004/0247367 | A1 | 12/2004 | Fontaine | |
| 2004/0247637 | A1 | 12/2004 | Voris et al. | |
| 2005/0013838 | A1 | 1/2005 | De La Poterie | |
| 2005/0031400 | A1 | 2/2005 | Marcotte et al. | |

(Continued)

FOREIGN PATENT DOCUMENTS

| | | |
|---|---|---|
| DE | 19839940 | 3/2000 |

(Continued)

OTHER PUBLICATIONS

PCT International Search Report; International Application No. PCT/US07/69759; Completion Date: Dec. 28, 2007; Date of Mailing: Mar. 3, 2008.

(Continued)

*Primary Examiner*—David J Walczak
(74) *Attorney, Agent, or Firm*—Peter Giancana

(57) ABSTRACT

Product applicators that are separable from a product reservoir and that heat a portion of product and a product applicator fitted with an electronic heating element capable of connecting to a low voltage power source. Most of the electric circuitry is incorporated into a circuit subassembly, for example a flexible substrate with printed-on circuit. The preferred heating element is a flexible heater. Heat emanates from the surface of the separable applicator so that the product that is closest to the applicator surface is heated prior to and/or during application.

41 Claims, 9 Drawing Sheets

U.S. PATENT DOCUMENTS

| | | | |
|---|---|---|---|
| 2005/0031656 | A1 | 2/2005 | Pays et al. |
| 2005/0058496 | A1 | 3/2005 | DeLaPoterie et al. |
| 2005/0244209 | A1 | 11/2005 | Gueret |
| 2005/0258172 | A1 | 11/2005 | Gueret |
| 2006/0032512 | A1 | 2/2006 | Kress et al. |
| 2006/0246118 | A1 | 11/2006 | Gueret |
| 2006/0251686 | A1 | 11/2006 | Gueret |
| 2007/0206986 | A1 | 9/2007 | Gueret |
| 2008/0273911 | A1 | 11/2008 | Gueret |
| 2009/0020133 | A1 | 1/2009 | Gueret |
| 2010/0054841 | A1 | 3/2010 | Cho |

FOREIGN PATENT DOCUMENTS

| | | |
|---|---|---|
| EP | 1563760 | 8/2005 |
| FR | 2891394 | 3/2007 |
| GB | 2174896 | 11/1986 |
| WO | WO 2007/114551 | 10/2007 |

OTHER PUBLICATIONS

PCT Written Opinion of the International Searching Authority, or the Declaration; International Application No. PCT/US07/69759; Completion Date: Dec. 28, 2007; Mailing Date: Mar. 3, 2008.

Minco, Thermofoil Heaters [online], 2005 [Retrieved on Mar. 22, 2006]. Retrieved from the Internet:<URL:http:www.minco.com/products/heaters.aspx.>.

Bouix and Jacob, "Cosmetic Applicators Containing Heating Elements," U.S. Appl. No. 12/730,789, filed Mar. 24, 2010.

Bouix and Jacob, "Heated Mascara Applicator and Suitable Compositions," U.S. Appl. No. 12/732,835, filed Mar. 26, 2010.

* cited by examiner

COSMETIC APPLICATORS CONTAINING HEATING ELEMENTS

FIELD OF THE INVENTION

The present invention pertains to product applicators that heat a portion of product as it is being dispensed from a container and/or as it is being applied to a surface. More specifically, the present invention is concerned with a type of applicator that is physically separate from a product reservoir during product application. Generally, devices according to the present invention create opportunities for improving product performance, enhancing consumer experience and expanding formulary options, while overcoming disadvantages of prior art heating or heated applicators.

BACKGROUND OF THE INVENTION

Product applicators are designed to deliver a quantity of product. In consumer goods there are, broadly, two types of applicators. There are applicators that are separable from a product container/reservoir. Throughout the specification, a "separable applicator" is one that is disconnected from a product reservoir at the time of applying product to a target surface. In use, a separable applicator is loaded with product from a product reservoir for transfer to a target surface. In contrast, there are applicators that are integral with a product container and therefore, the applicator cannot be separated from the product container. This type of device dispenses product by causing the product to flow from a reservoir, through the interior of an applicator, and out an exit structure, for transfer to a target surface.

Either applicator type is known to be coupled with a heating element to heat a product prior to and/or during dispensing and application. Specifically, there are such devices in the personal care and cosmetics fields. The present invention is concerned with the first type of heated applicator, that which is separable from a product container.

A heated applicator that is separable from a product container has different issues than a heated applicator that is integral with a dispensing container. In the case of a heated applicator that is separated from a product container at the time of use, the electronic circuitry must be housed solely within the applicator, and not within the container, if power is to be continuously supplied to the applicator. In contrast, in the case of an applicator that is integral with a dispensing container, the electronics is not limited to being housed within the applicator. The container portion provides substantially more space for a layout of electric circuits. In fact, dispensing containers with integral applicators and heating elements may be no larger than dispensing containers with integral applicators having no heating elements. Separable applicators are different, at least in cosmetics and personal care. Here, such applicators tend to be sleek and designed for easy storage in a small purse or pocket. In the personal care field, the drive is always to make smaller, more convenient applicators of this type. Therefore, when the addition of heating components to an applicator requires making the applicator larger, this is a clear disadvantage. This disadvantage is not as often encountered when designing dispensing containers with integral applicators, because dispensing containers with integral applicators do not have to be enlarged at all or to the same degree as separable applicators. The present application is concerned with separable heated applicators. The following will make clear the shortcomings of known devices of this type.

U.S. Pat. No. 5,775,344 discloses a brush-type applicator, for example, a mascara applicator, that comprises a battery, an on/off switch, and a heat facilitating strip that extends the length of the applicator rod, on the inside of the rod. However, to be effective, this patent teaches that the product reservoir must be separately heated by additional batteries and heat facilitating strips, so that the entire contents of the reservoir is uniformly and continuously heated during use. This is a disadvantage in that not all cosmetics, not even all mascaras, can be repeatedly heated and cooled without damaging the product. Therefore, this prior art device is unsuitable for products that are altered structurally or chemically by the application of too much heat or from being too often heated. This is unlike the present invention, wherein the product remaining in the reservoir is not substantially heated or heated to a much lesser degree and remains in good condition for future use. Another disadvantage of the '344 device is the additional power that must be consumed to raise the temperature of the entire contents and volume of the reservoir. This is costly and inconvenient if batteries need to be replaced often. In acknowledging this problem, the '344 reference suggests insulating the exterior walls of the container. Although no details for doing this are disclosed, it certainly makes this applicator more complex and costly than the present invention, wherein the reservoir does not need to be insulated.

It should be noted that the '344 reference does not disclose how to construct a mascara applicator with a heat facilitating strip that extends the length of the applicator rod, on the inside of the rod. No details about the heat facilitating strip or the rod are given. From the figures, one may only assume that the heat facilitating strip is a simple resistive filament. Nothing can be known for sure about the rod. Also, it is not known from this reference if a heated applicator according to the reference, by itself, in the absence of separately heating the reservoir, would be effective. Since the reference discloses the need to heat the reservoir, it may be assumed that the heated applicator of the reference could not by itself produce any useful result. It may be that a heated applicator according to the reference was unable to generate enough heat by itself, to be effective. Again, it is difficult to tell because the reference is vague on the details of the applicator construction. Nevertheless, it is the applicant's believe that construction of a mascara applicator according to '344 is not convenient from a mass manufacturing or economic point of view.

In contrast, the present invention is a heated applicator that provides sufficient energy to effectively heat a product with which it comes in contact, the reservoir not needing to be separately heated. Separate power sources and circuitry for the reservoir are optional, but not essential. An applicator according to the present invention can be adjusted so that the contents of a product reservoir are not adversely affected by the repeated heating and cooling. Furthermore, the application of the present invention uses printed circuit technology, including flexible printed circuit technology, that makes mass manufacture of heated applicators convenient and cost effective.

Seemingly, all heated cosmetic and personal care applicators utilize conventional, flexible metallic wiring and contacts for conducting electricity from a power source to a switch, then to a heating element and possibly to one or more light indicators and temperature controls, before returning to the power source. If more than one independent circuit is required, as in the '344 patent for example, then the number of wires and electrical connections increases proportionately. There are several disadvantages to this situation. First, there is the need to fit all of these flexible, flimsy wires into a small cosmetic device. Assembling such devices may need to be done by hand because of the need to fit it all in while not damaging any of the circuitry. Also, the overall size of the dispensing device may be constrained by the need for enough space to fit all of the circuitry. This may require a larger device than is aesthetically appealing or larger than a consumer has come to expect. In markets where appearance, feel and ergonomics play a significant role in market success, this disadvantage is serious. Another disadvantage is the number and type of electrical connections that must be made in a heated applicator device having stranded wire conductors. These connections may be made by soldering or twisting conductors together. Either of these is labor intensive and cost ineffective. With repeated use and wear and tear, connections of this sort may eventually fail. The result is a useless applicator and frustrated consumer. Yet another disadvantage is the relatively unsophisticated circuitry that can be reasonably incorporated into a small, inexpensive cosmetic applicator. In contrast, a heated applicator according to the present invention does not use metal wire conductors or uses substantially fewer, does not have the space constraints associated with using wire circuitry, substantially reduces the labor required to assemble an applicator and has more reliable electrical connections and sophisticated electrical options than prior art applicators.

OBJECTS

The main object of the present invention is to provide an improved heated applicator for cosmetic and dermatologic products wherein the applicator is separable from a product reservoir and wherein the applicator comprises a heating element capable of effectively heating a product. Further objects of the present invention include providing a heating applicator that is safer to use and that has more reliable electronics than prior art heating applicators; that is more convenient to use, more portable and less bulky than prior art heating applicators; that is simpler to manufacture and assemble than prior art heating applicators; that has more sophisticated electronics, like better temperature controls, than prior art heating applicators; and that may be used on any kind of separable applicator.

SUMMARY OF THE INVENTION

All of the foregoing and more are achieved with a product applicator fitted with an electronic heating element capable of connecting to a low voltage power source. Most of the electric circuitry is incorporated into a circuit subassembly, for example a flexible substrate with printed-on circuit. Heat emanates from the surface of the separable applicator so that the product that is closest to the applicator surface is heated prior to and/or during application. Product forms that may find use with the present invention include: liquids, creams, lotions, emulsions, powders, foams, gels and serums. The present invention is useful for applying cosmetic and dermatologic treatment products of all types, including products to treat hair, skin and nails. Suitable skin treatment products include those effective on the surface of the skin and those effective at deeper layers of the skin. The present invention is useful for applying cosmetic or dermatologic make-up products of all types, including those that apply color to the skin, hair or nails for short term wear (i.e. less than twenty-four hours) or longer term wear (i.e. more than twenty-four hours). The present invention may be useful to activate a product just prior to its application. The full benefits of present invention are realized by the use of a flexible, modular electronic circuit subassembly, suitably designed for personal care product applications. This and other aspects of the invention will be discussed herein.

DETAILED DESCRIPTION OF THE INVENTION

Throughout this specification, the terms "comprise," "comprises," "comprising" and the like shall consistently mean that a collection of objects is not limited to those objects specifically recited.

Throughout this specification "effectively heating a product" means that the heating element housed in the applicator is sufficient, by itself, to impart to the product or a user, a full intended benefit, secondary heating means not being needed.

Throughout this specification "activate a product" or the like means that heating a portion of product alters the portion of product to exhibit behavior that it did not exhibit just prior to being heated. "Activate a product" also means to alter (either enhancing or diminishing) one or more properties of the unheated product.

Throughout the specification "cosmetic" means any topical preparation, such as those mentioned above, that beautify, alter the appearance, provide a benefit to the surface to which they are applied or provide a benefit to the subject to which they are applied. "Cosmetic" includes dermatological, pharmaceutical and nutraceutical preparations.

Figure 1:
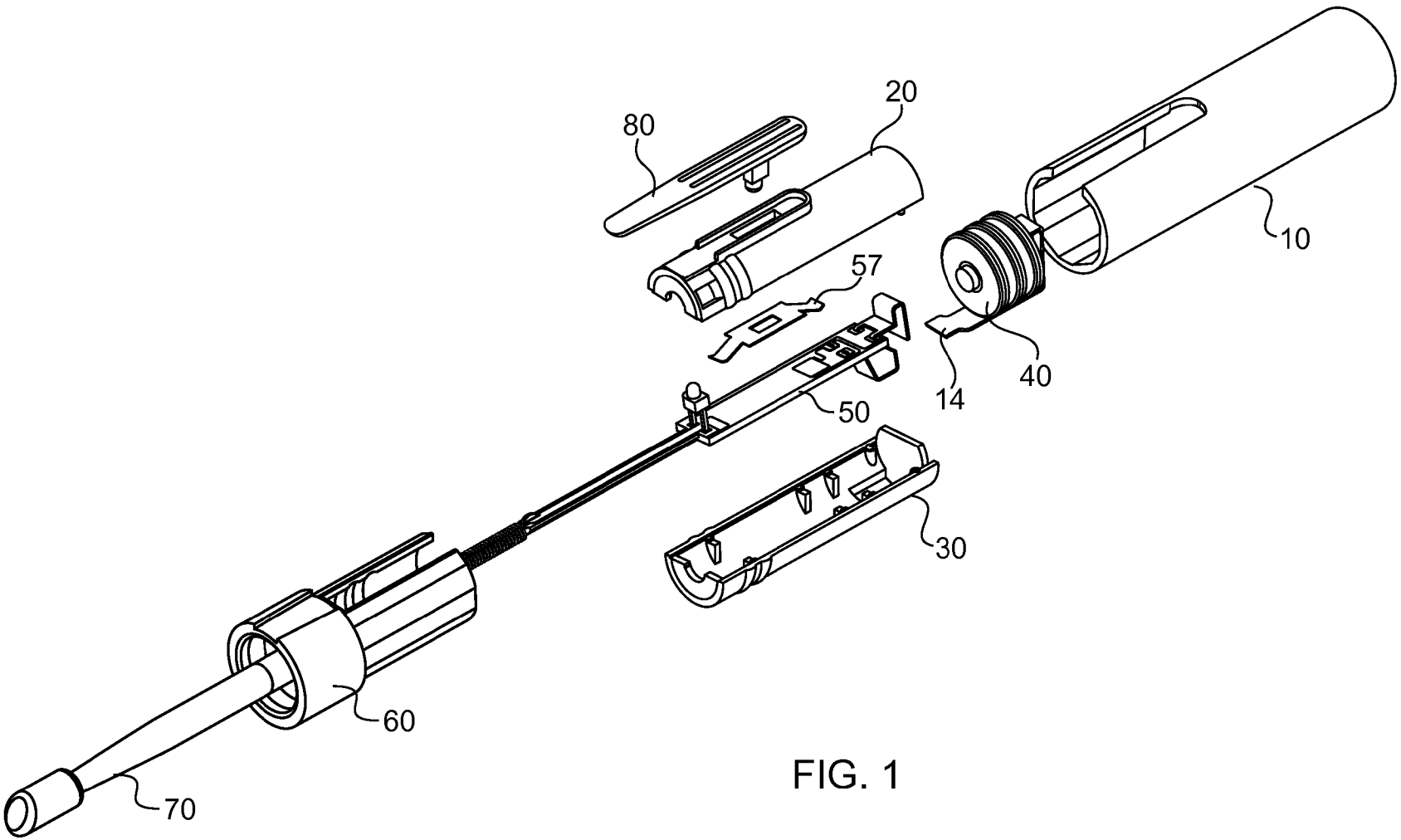
FIG. 1 is an exploded view of one embodiment of an applicator according to the present invention.

The exploded view of FIG. 1 provides a visual summary of the main features of an applicator according to the present invention. Element (10) is a handle; (20) is an upper shell; (30) a lower shell; (40) is an electric current/power source; (50) is a printed circuit subassembly including a resistive heating element; (60) is a stem; (70) is an applicator tip and (80) is an on-off switch.

Figure 2:
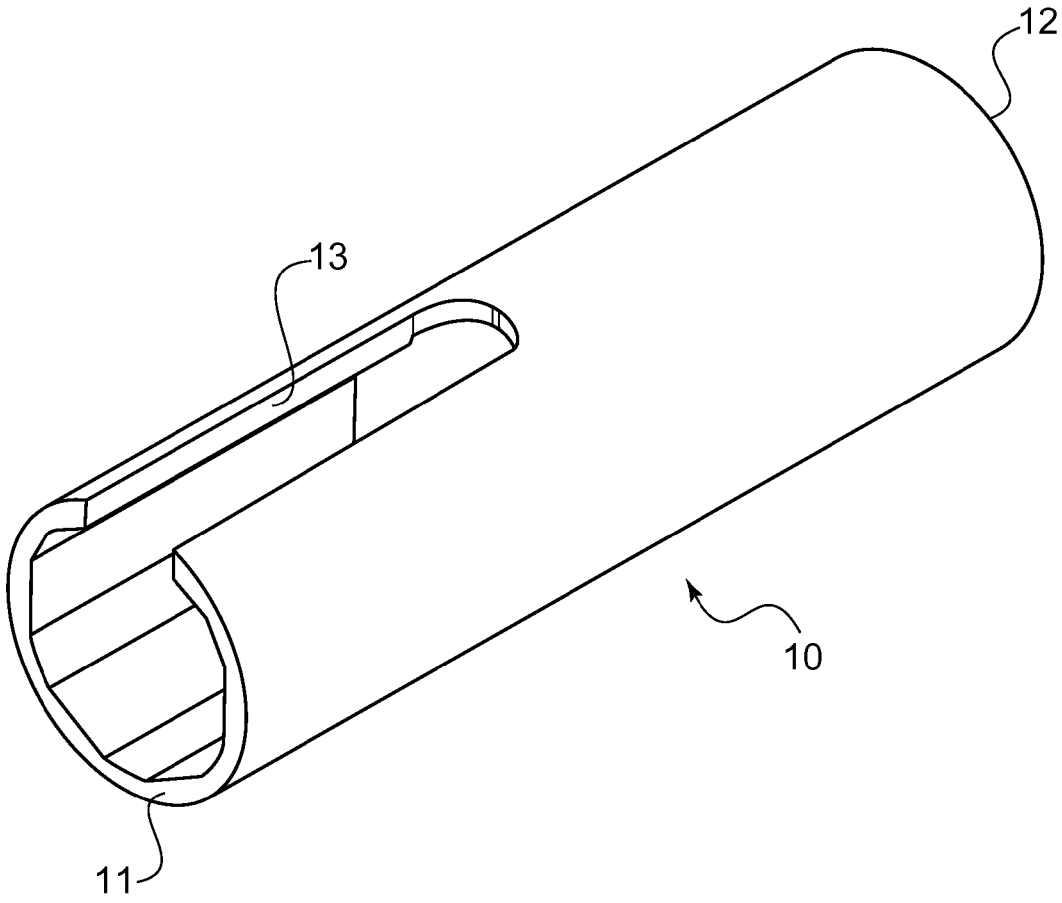
FIG. 2 is a perspective view of the handle of FIG. 1.

The handle 10 is shown in FIGS. 1 and 2 as basically cylindrical and opened at a first end (11), which makes it capable to receive the current source (40) and a proximal portion of the circuit subassembly (50). A second end (12) of the cylindrical handle is preferably closed to protect those elements inside the handle, but may have an opening in case that is advantageous. The shape of the handle may be any suitable shape to receive the current source and a proximal portion of the heated applicator. The handle has an elongated slot (13) which may open onto the first end (11) of the handle, as in FIGS. 1 and 2, or which may be confined between the ends (11, 12) of the handle (not shown). The slot is suitable for receiving a sliding switch. A window may also be provided in the handle wall, placed so that an indicator light housed in the handle, may shine through the window. The handle may support a positive and/or negative electrical lead (14). When the current source is housed in the handle, the positive and/or negative leads, if provided, contact the positive and negative terminals of the current source. The electrical leads of the handle are provided when it is necessary to complete the circuit between the current source and the circuit subassembly. They may be attached to the inner wall of the handle by any suitable means.

Figure 3A:
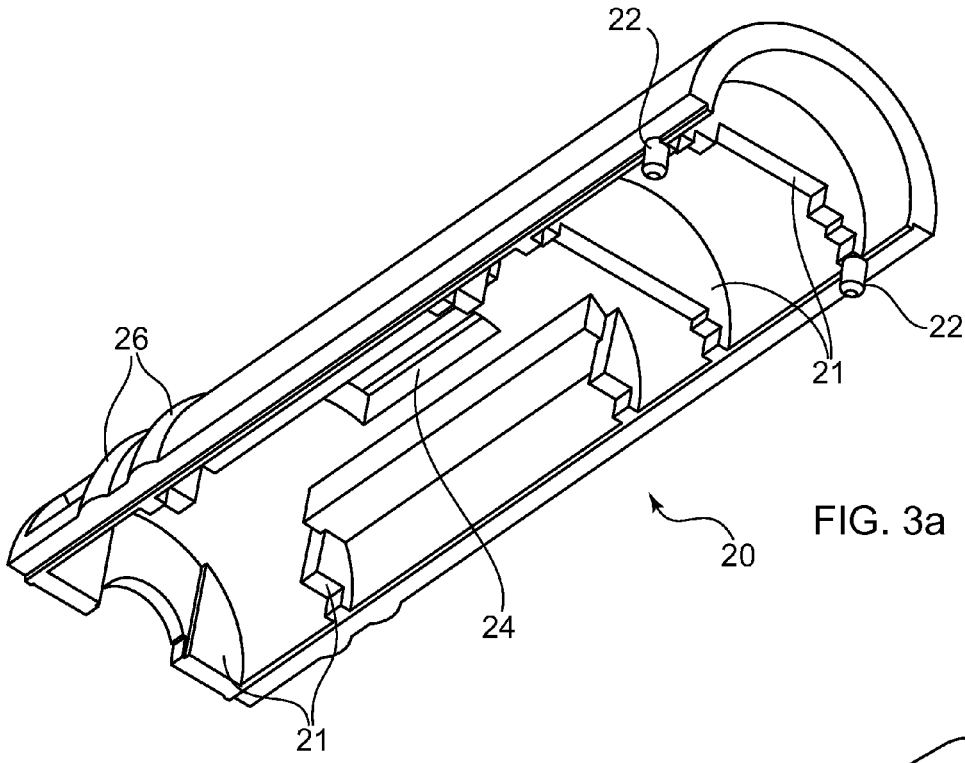
FIG. 3*a* is a perspective view of the interior of the upper shell of FIG. 1.
Figure 3B:
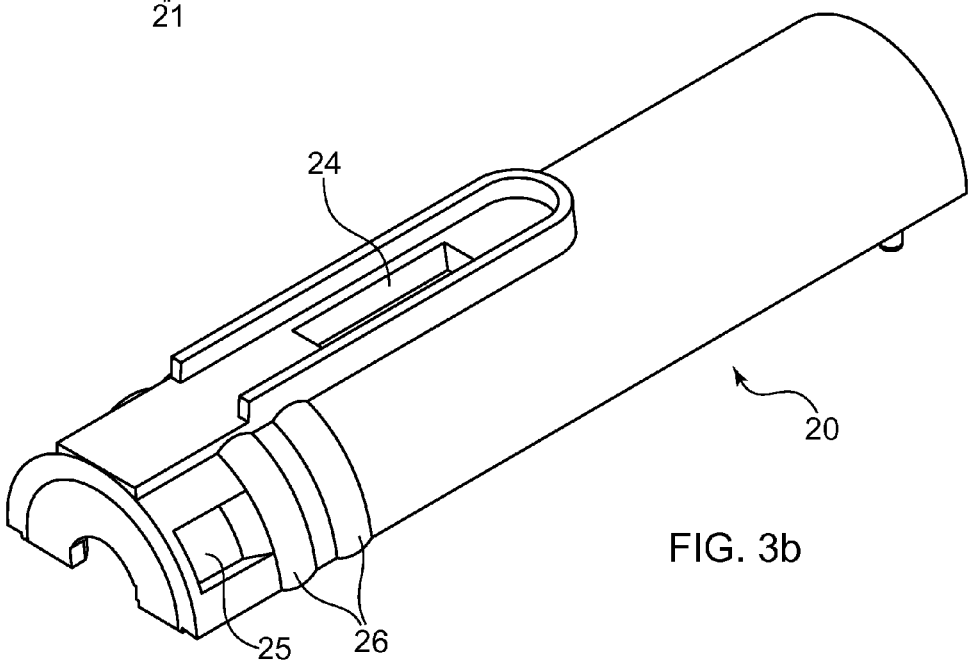
FIG. 3*b* is a perspective view of the exterior of the upper shell of FIG. 3*a*.
Figure 4A:
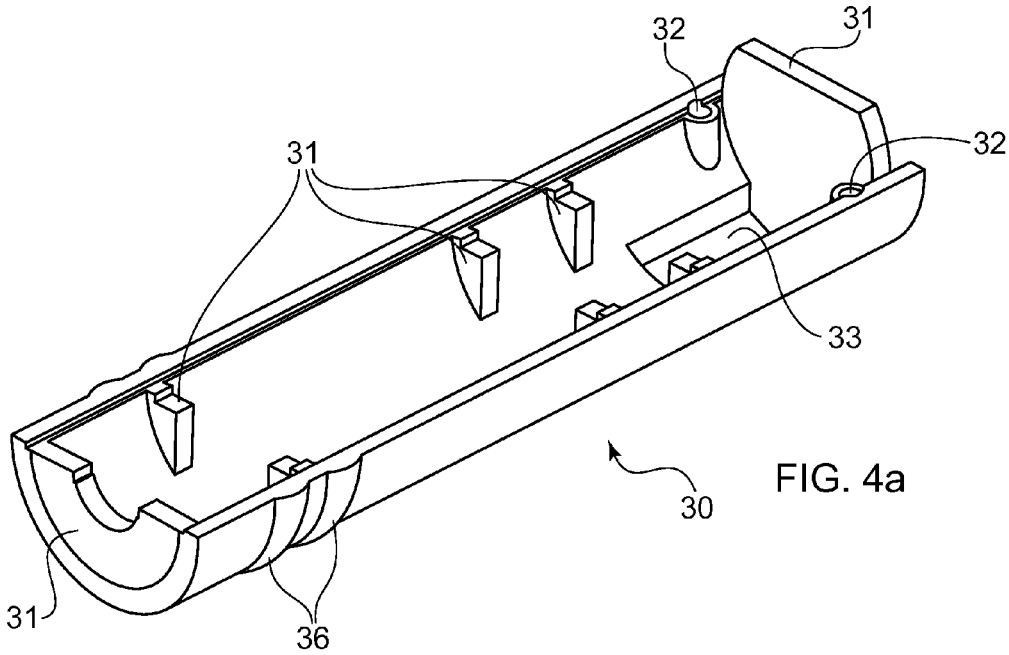
FIG. 4*a* is a perspective view of the interior of the lower shell of FIG. 1.
Figure 4B:
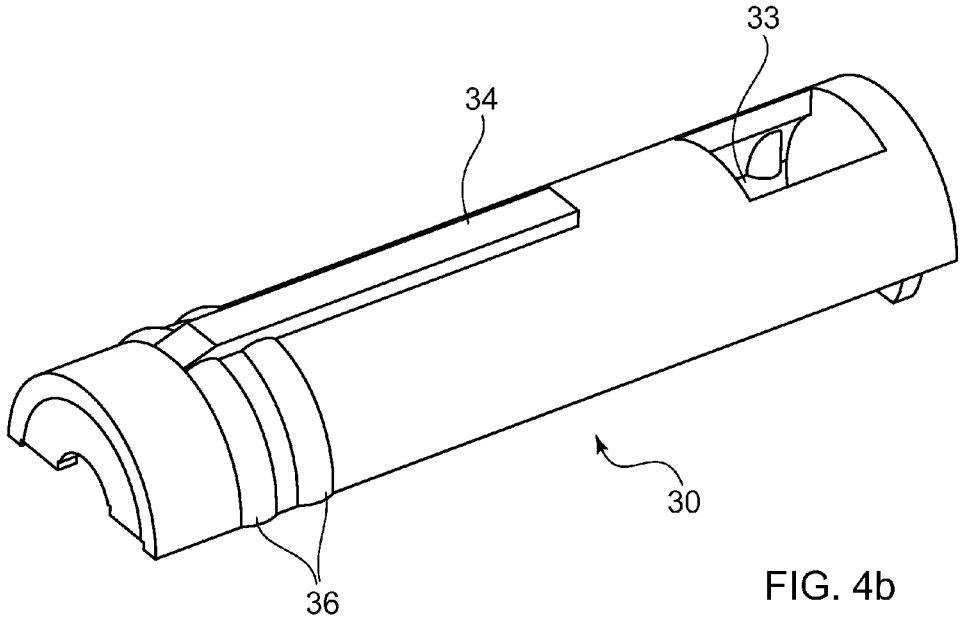
FIG. 4*b* is a perspective view of the exterior of the lower shell of FIG. 4*a*.

An upper shell (20) and lower shell (30) cooperate to support portions of the device and hold them in working relationship. In FIGS. 3*a,b* and 4*a,b*, the upper and lower shells are shown as semi-cylindrical. When snapped together, these parts form a cylinder that is sized to fit, at least partially, into the cylindrical handle (10). The upper and lower shells may be any shape that conveniently and securely fits into the handle. The interior of the upper shell can be seen in FIG. 3*a* and that of the lower shell is seen in FIG. 4*a*. As shown, the upper shell is preferably provided with assorted support structures (21), while the lower shell is preferably provided with assorted support structures (31). Together these support structures secure the printed circuit (50). The interiors of the upper and lower shells may include any structure that provides stability to the device, overall. The upper and lower shell may be held together by any suitable means, including snap fit, friction fit, adhesive and welding. In FIG. 3*a*, plugs (22) are provided to fit into cooperating recesses (32), in FIG. 4*a*. When joined together, the upper and lower shells provide a rear opening (23, FIG. 5) through which a positive electrode (51) may pass between a positive terminal (41) of the current source (40) and the printed circuit (50). As seen in FIGS. 4*a* and 4*b*, an opening (33) is provided in the wall of the lower shell. This opening allows a negative electrode (52) to pass between a negative terminal (42) of the current source and the printed circuit. With this configuration, the current source, i.e. battery, is located outside of the upper and lower shells, where it may be accessed for replacement. A switch opening (24) is located in the wall of the upper shell. This opening allows a portion (81, see FIG. 5) of a switch (80) to pass from the outside to the inside of the device. A window (25) may be provided in the wall of the upper shell, placed so that an indicator light housed in the shell, may shine through the window. Also, the lower shell may be provided with an assembly extension (34), whose relevance will be explained below. A similar feature may be provided on the upper shell.

Figure 5:
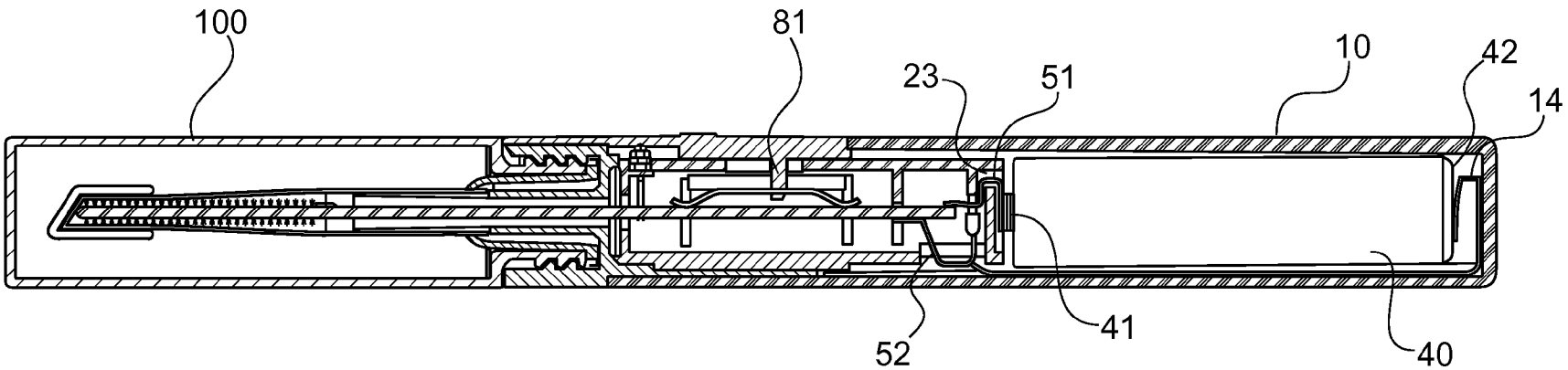
FIG. 5 is a cross section of a heated applicator with reservoir. The applicator is similar to that of FIG. 1, but the handle houses a different type of battery.

Referring to FIG. 5, a current source (40) provides electrical energy to a resistive element that generates heat. The current source is housed in the handle (10). A positive terminal (41) of the current source is in electrical contact with the positive electrode (51) that leads to the printed circuit. A negative terminal (42) of the current source is in electrical contact with the negative electrode (52) that leads from the printed circuit. "Electrical contact" means that, in a closed circuit, current will flow between the parts mentioned, regardless of any number of intervening parts.

Preferably, the current source (40) comprises a DC power supply. In the preferred embodiment, the DC power supply is one or more batteries. Common household batteries, such as those used in flashlights and smoke detectors, selected to provide the resistive element with the proper current and voltage, are preferred. These typically include what are known as AA, AAA, C, D and 9 volt batteries. Other batteries that may be appropriate are those commonly found in cell phones, hearing aides, wrist watches and 35 mm cameras. The present invention is not limited by the type of chemistry used in the battery. Examples of battery chemistry include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries.

Other sources of DC current include solar cell technology, as found in many handheld devices, for example calculators and cell phones. According to this embodiment, one or more light collecting portions are located where sunlight or artificial light may shine on it. For example, the light collecting portions may be located on the outside surface of the handle, parallel to the axis of the handle. When light impinges the light collecting portions, the light energy is converted to electrical current for supplying the resistive element, via well known light cell technology. Optionally, a storage cell may be provided to store any unused electrical energy created by a photo cell, which may later be used to supply the resistive heating element, as for example when the lighting is too dim to create an adequate photo-current for the heating element.

Figure 9A:
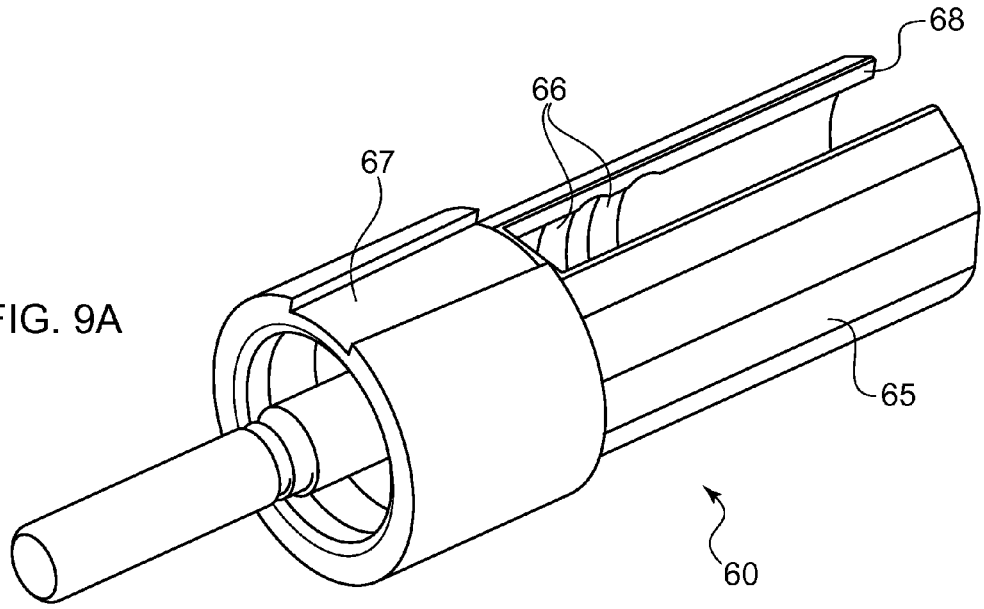
FIGS. 9*a* and 9*b* are perspective views of the stem of FIG. 1.
Figure 9B:
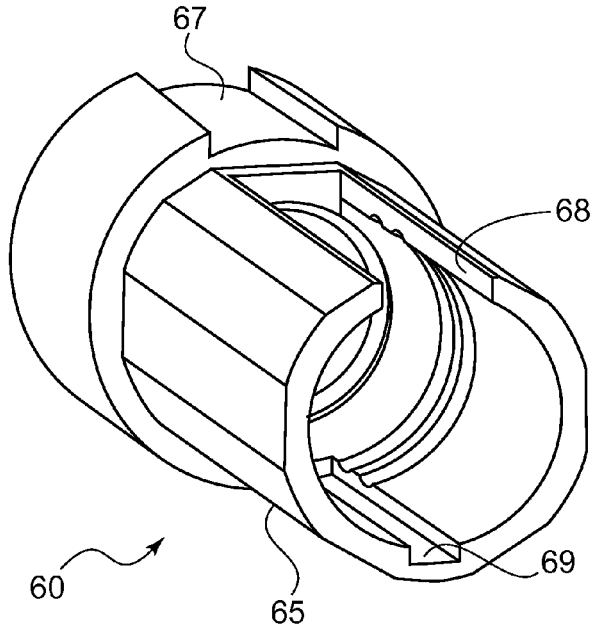

A stem (60) intervenes between the handle (10) and the applicator tip (70) to hold those parts together. Any suitable means may be used to secure the handle and tip to the stem, however, the handle and stem should maintain a fixed relationship during normal use. Otherwise, when a user applies a torque to the handle (screwing or unscrewing, for example), relative motion between the handle and stem may damage the internal components, as well as frustrate the user's efforts to open or close the device. Thus, for example, the parts may snap fit or friction fit such that they are not easily separated in normal use of the invention, but may be separated intentionally, as for changing the battery. Alternatively, the handle and tip may be adhered to the stem by adhesive or by welding or integral molding. In this case, changing the battery may not be possible and the applicator is intended to be disposed without battery replacement. Furthermore, the stem (60) and tip (70) are preferably joined in a permanent fashion, such that there is little or no relative movement between these parts. In the embodiment of FIG. 5, the handle and tip are friction fit onto the stem. As seen in FIGS. 9*a* and 9*b*, an elongated portion (65) is provided which receives the upper and lower shells (20, 30), and itself, extends into the handle (10). The elongated portion may have a geometry that cooperates with the internal handle geometry to hold those two components in a fixed relationship during normal use, negating any appreciable relative motion. Nevertheless, in between normal uses, the handle may be withdrawn from the elongated portion to expose the batteries, as needed.

Optionally, the upper (20) and lower (30) shells may have one or more interference beads (26, 36) that cooperate with one or more bead receiving grooves (66) on the inside of the stem (60). Optionally, the stem may have a slot (67) and a switch groove (68) for receiving the sliding switch (80). Optionally, the stem may have one or more assembly grooves (69) which are positioned to receive the assembly extension (34) of the lower (and/or upper) shell. This feature would help to ensure proper alignment of components during assembly of the device. The stem is also capable of attaching and detaching from a product container or reservoir (100). When attached, the applicator tip is immersed in the reservoir. Preferably, the stem and reservoir engage via cooperating threads. Preferably, the stem can be screwed onto the reservoir until the stem rests against the opening of the reservoir to seal the reservoir. A gasket or liner may be located inside the stem, in the usual manner, to ensure an effective seal of the reservoir.

Figures 10A, 10B:
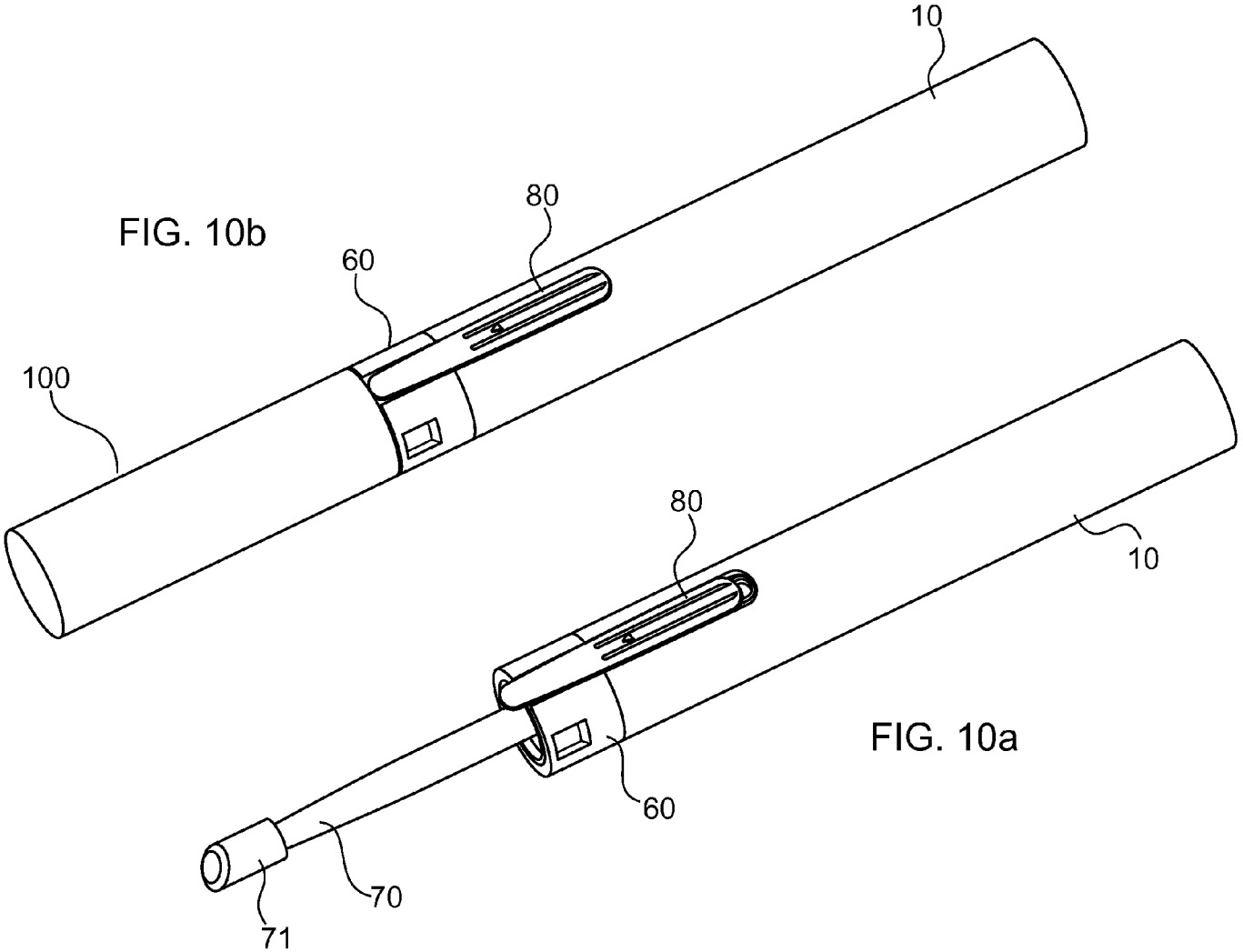
FIG. 10*a* is a perspective view of the assembled applicator of FIG. 1.
FIG. 10*b* is a perspective view of the assembled applicator of FIG. 1 mounted to a container.

The applicator tip (70) is an elongated member that houses a portion of the circuit subassembly (50), in particular, the heat generating portion (90). Preferably, the applicator tip is water-tight and the connection between the applicator tip and the stem is water-tight. The "working portion" (71 in FIG. 10*a*) of the tip is that outer surface portion that extends from the distal end of the tip back toward the handle. This will generally be the portion of the tip that is used to convey product from the reservoir to an application surface. Therefore, the working portion may incorporate any features that facilitate that step. For example, consideration may be given to the shape of the working portion of the tip such that the working portion is shaped for applying cosmetic to a specific portion of the body: a relatively small working portion for application to the eye area; a working portion in the shape of a lipstick bullet for delivery of products to the lips; a relatively larger, extended flat surface for delivery of product to extended surfaces of the body, i.e. the arms and legs. A working portion of any useful shape may be used.

Another tip feature where variation is possible, is the texture of the working portion (71). The working portion may be smooth or textured to facilitate pick and delivery of product. Texture may be provided by treating the surface of the tip. For example, the tip may be overlaid with absorbent or exfoliating material. Flocking the tip is one example of providing an absorbent material that takes up more product from the reservoir than a naked tip, and can also facilitate application to the application surface. A sponge is another example. Alternatively, an exfoliating tip may be used so that at the time of application the heated product may better penetrate the skin. In this case, both the exfoliating action and the heat from the applicator work to open the pores of the skin to receive product at a deeper level. An exfoliating working portion may be provided by covering the distal end of the tip with an abrasive material or by molding a raised and embossed pattern into the tip itself.

The whole elongated tip (70) or any portion thereof, may be straight or curved. It may be beneficial to curve the whole tip if that shape facilitates delivery of product to a particular area of the body that would be harder to reach or harder to coat with product if the tip was not curved. For example, sometimes curved or arced applicators are used on the eyelids or eyelashes.

At least a portion of the applicator tip (70) is capable of conducting heat from the heat generating portion (90) inside the applicator tip to the outer surface of the applicator tip. Preferably, this portion is the working portion (71) of the applicator tip. When the working portion of the applicator tip is covered with product, heat from the heat generating portion passes through the working portion and into the product. Suitable heat conducting materials for the tip include, for example, one or more metals or ceramics; aluminum and stainless steel, for example. Optionally, some portions of the applicator tip may be insulators of heat. By insulating the non-working portion of the tip, energy may be saved, the product may be heated more efficiently and the consumer may be spared any inadvertent or unwanted exposure to heat. One method of heat insulation may include flocked fibers covering the portion of the tip to be insulated. The fibers may be attached to the tip by a polyester glue. Suitable fibers may be nylon fibers, about 0.4 mm in diameter and about 1 mm in length, for example.

A means for opening and closing an electric circuit is provided. Many such means are possible and well known to a person of ordinary skill in the art, such as multi-position switches and pressure activated buttons. One non-limiting example is a sliding switch. Sliding switch (80) is accessible by a user and turns the device on or off. An extension (81, see FIG. 5) of the switch, extends from the underside of the sliding switch, through a switch opening (24), located in the wall of the upper shell, where it engages a sliding contact (57, see FIG. 1). The sliding contact is capable of sliding between an opened and closed position. The sliding contact has two ends. In the on position, each end contacts a respective stationary contact (56, 58). In the off position, fewer than both of the ends of the sliding contact have contact with their respective stationary contacts. Optionally, in the "on" position, the sliding switch (80) may be configured to extend through the stem slot (67) and beyond the stem (60). The purpose of this is to prevent a user from leaving the heating circuit on after returning the applicator to the closed position on the reservoir (100). If the sliding switch is extended beyond the stem and a user seats the stem onto the reservoir, then the switch will contact the reservoir and the switch will be made to slide to the off position. Alternatively, the configuration of the switch may be such that the stem cannot be fully seated on the reservoir while the switch is in the on position. This would signal the user to turn off the switch. Many arrangements are possible depending on the kind of switch and the exact geometry of the device.

Raising the temperature of a product depends on the rate of heat generation within the heat generating portion (90) and on the rate of heat transfer through the conductive portion of the applicator tip (70). These must be sufficient to raise the product from an ambient temperature to an application temperature. Product application temperature is that temperature or range of temperatures, for which a particular product having a particular application is effective. The present invention encompasses product application temperatures at least in the range of 40° F. to 120° F. The low end of this range is intended for products that may be used in cold environments, where raising the product temperature up to 40° F. may be sufficient to activate the product. For example, due to the low ambient temperature the product in the reservoir may be frozen, in which case being able to raise the product's temperature above 32° F. is beneficial. At the other end, products raised beyond about 120° F. may be too hot for cosmetic and skin care applications. However, where it may be beneficial, there is, in principle, nothing about the device of the present invention that limits the product application temperature to 40° F. to 120° F. In conventional cosmetic use, a product temperature of about 95° F. often provides a pleasant application for the consumer, while a product temperature below about 85° F. may seem tepid and somewhat unsatisfying. In each specific situation, the optimum product temperature will depend on the physical characteristics of the product being applied. Parameters like texture, viscosity, pH, etc. will generally be considered in determining the optimum product application temperature. It is within the scope of a person of ordinary skill in the art to determine by trial error, a suitable product application temperature. It is also within the scope of a person of ordinary skill in the art to determine, by trial and error, a rate of heat transfer to the product that is sufficient to alter one or more physical characteristics of the product. For example, it may be desirable to provide a product which, at ambient conditions in the reservoir (100), is relatively viscous. In this case the heat generating portion may be selected such that the rate of heat transfer into the product is sufficient to lower the viscosity of the product at the time of application.

Due to heat losses to the environment in the space between the heat generating portion (90) and the product and due to heat losses from the product surface to the ambient atmosphere, the heat generating portion must be capable of temperatures that are higher than the desired product application temperature. The rates of heat generation and transfer required for the specific product application can be worked out from basic thermodynamic principles and/or may be verified by routine experimentation. For example, in one working model of the present invention (a flocked tip applicator), a product application temperature of 95° F. was achieved when the heat generating portion (90) achieved a surface temperature of about 140° F. In that experiment, the heat conducting portion of the tip (70) achieved a temperature of about 113° F. The temperature of the tip is another consideration, because the tip may contact the skin during use. Thus, it is preferable to achieve the desired product application temperature while keeping the temperature of the tip below 120° F., or even better below 115° F.

For a wide range of applications, the applicator tip, heat generating portion (90) and power source as herein described, are capable of achieving the necessary rate of heat generation and heat transfer. Preferably, these rates are sufficient to raise the temperature of the product in a reasonable amount of time. A reasonable amount of time is a time that does not frustrate the consumer by having to wait too long before using the heated applicator. This will vary depending on the specific application and the expectations of the consumer. For example, for a consumer making a cosmetic application, a reasonable amount of time may be one minute of less, preferably less than ten seconds and most preferably less than about five seconds. By heating the product quickly, the consumer is assured of applying only heated product. Optionally, the electronic circuitry may include a means for sampling the temperature of the applicator tip or of the product on the applicator tip and a means of providing the user with an indication that the product has reached a certain temperature or is ready to be applied or needs more time. For example, the applicator tip may be fashioned of a thermochromic material that changes to a certain color when a specific temperature is reached. Optionally, the circuit subassembly (50) may include means to adjust the rate at which electric power is converted into heat. For example, a rheostat operable by a user, may be provided in a manner known in the art.

The reservoir (100) is non-specific except that, preferably, it is capable of forming an airtight and liquid tight seal with the stem (60). Otherwise, the reservoir may be any size or shape that accommodates a quantity of product and that is capable of receiving the applicator tip (70). Optionally, but often the case, the container comprises a neck finish having screw threads on the outer surface of the neck. Optionally, but often the case, a wiper is provided in the neck finish of the reservoir, its structure and purpose being well known in the art. The wiper removes excess product from the elongated applicator tip as the applicator tip is withdrawn from the reservoir. In this way, the applicator tip is evenly coated with product and rendered less messy.

The circuit subassembly (50, see FIGS. 6-8) extends from inside the upper and lower shells (20, 30), through the stem (60) and into the applicator tip (70). The circuit subassembly comprises a substrate (53) that is non-conductive to electricity and that supports various conductive elements, which elements form a portion of an electric circuit. Suitable substrate materials include, but are not limited to, epoxy resin, glass epoxy and Bakelite (a thermosetting phenol formaldehyde resin). The substrate is preferably about 0.5 to 2.0 mm thick. Portions of one or both sides of the substrate may be covered with a layer of copper, say about 35 μm thick. In a preferred embodiment of the invention, the circuit subassembly is implemented as a printed circuit according to printed circuit technology known in the art of printed circuits. In this embodiment, various conductive elements are printed on the substrate (53). These printed elements, in combination with the positive and negative electrodes (51, 52), sliding contact (57) and heat generating portion (90), form a closed circuit. A circuit supported on a substrate, as thus described, is flexible to a more or less degree, depending on the exact thickness of the substrate and the flexibility of the heat generating portion.

The heat generating portion (90) may also be printed on the substrate. However, in a preferred embodiment, the heat generating portion is separate component, preferably at least as flexible as the substrate (53). In the figures, the heat generating portion is shown as winding of round resistive wire. This is a potentially effective, yet disadvantaged heat generating portion. The winding provides an amount of heat generating surface area that is sufficient to raise the temperature of the product, however, the winding is long and the generated heat is diffused over a relatively large area, heating a relatively large volume of product. We could say that this heat generating means is not targeted. As a result, heating time before application is greater than it would be if a more targeted heat generating portion was available. Also, the simple winding of round wire tends to limit the flexibility of the circuit subassembly.

In contrast, there is a general class of heaters known as "flexible heaters", originally designed for the aerospace and defense industries, where applications included maintaining constant temperatures in the instrumentation of aircraft, satellites, navigation, guidance and radar equipment, but many other uses outside of aerospace have since been discovered. Advantageous characteristics of flexible heaters include their light weight, thin profile and flexibility. Also, theses heaters can be configured into virtually any pattern to provide targeted heat concentration. Complex shapes, contours and three-dimensional patterns are possible. One example of flexible heaters are those supplied by Ogden Manufacturing Co. of Pittsburgh, Pa. A preferred flexible heater is supplied by Minco Products, Inc (Minneapolis, Minn.) under the name Thermofoil™. Thermofoil™ heaters and their equivalent offer a significant number of advantages over wire-wound resistive elements. According to Minco's website, "Thermofoil™ heaters are thin, flexible heating elements consisting of an etched foil resistive element laminated between layers of flexible insulation." Further, "Thermofoil™ heaters put heat where you need it. You simply apply them to the surface of the part to be heated. Their thin profile gives close thermal coupling between the heater and heat sink. You can even specify profiled heat patterns with higher watt densities in areas where heat loss is greater." Further, "The flat foil element of Thermofoil™ heaters transfers heat more efficiently, over a larger surface area, than round wire. Thermofoil™ heaters, therefore, develop less thermal gradient between the resistive element and heat sink. Heaters stay cooler. The result is higher allowable watt densities, faster warm-up, and prolonged insulation life. Thermofoil™ heaters can safely run at wattages twice those of their wire-wound equivalents. Insulation life may be ten times greater." The advantages of a flexible heaters are uniquely suited the present invention, where the surface area to be heated is small and targeted, where fast warm-up is critical to marketplace success and where flexibility of the componentry improves the manufacturing and assembly process. The present invention is novel and non-obvious over the prior art because nothing in the prior art suggests a topical product applicator incorporating flexible printed circuit substrate and a flexible, targeted heater technologies.

Figure 6:
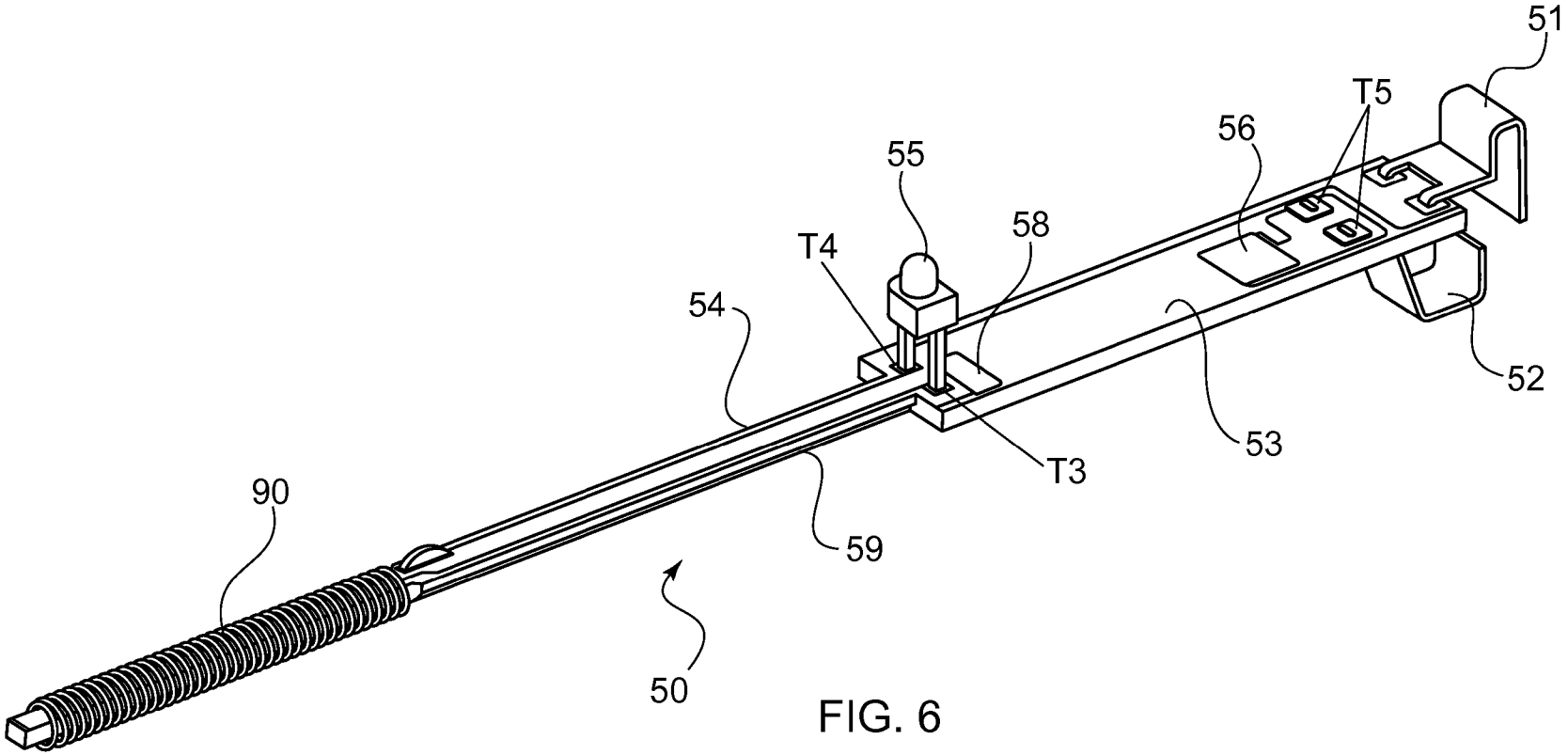
FIG. 6 is a perspective view of one embodiment of a printed circuit subassembly useful in the present invention.
Figure 7:
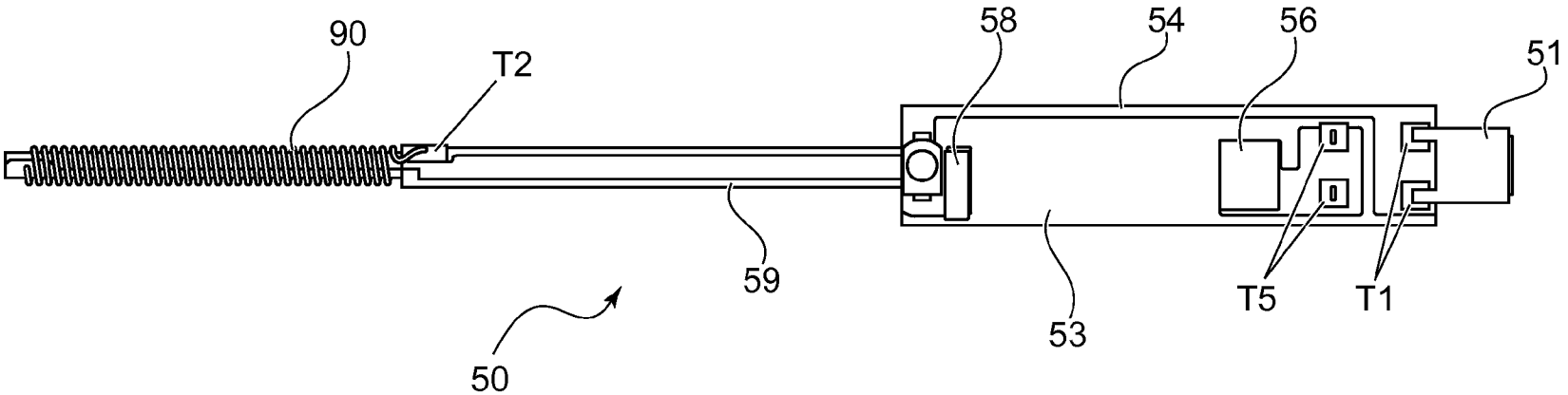
FIG. 7 is a plan view of the circuit subassembly of FIG. 6.
Figure 8:
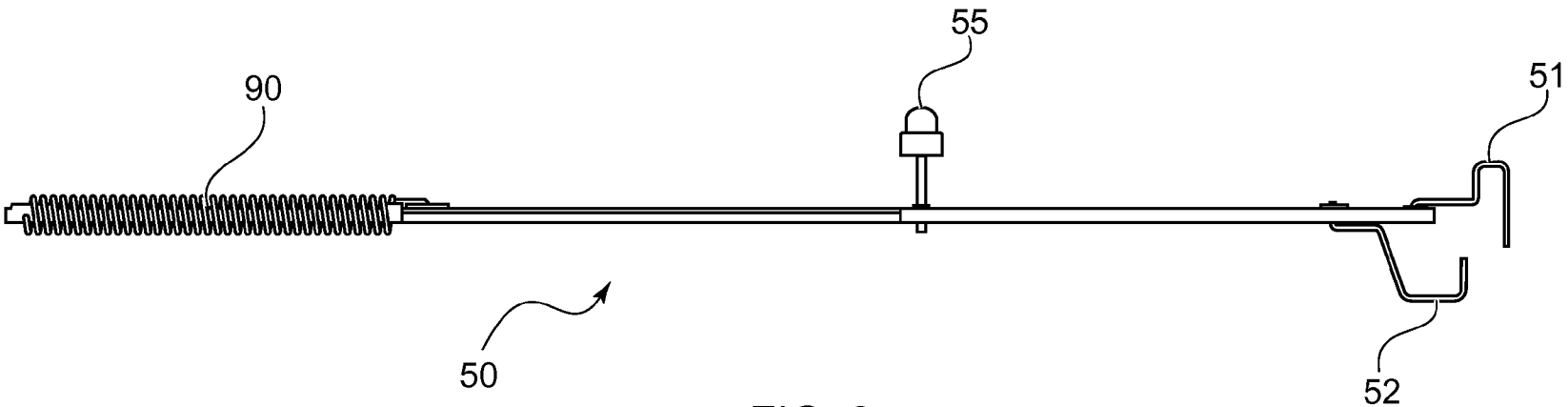
FIG. 8 is an elevation view of the circuit subassembly of FIG. 6.

The number and location of printed conductive elements can vary depending on the layout and complexity of the circuitry. A relatively simple, yet effective circuit is shown in FIGS. 6 and 7. Positive electrode (51) is the first portion of the circuit subassembly (50) path, which is capable of receiving electric current from the positive terminal (41) of the battery, either through direct contact with the positive terminal or through an intervening positive battery lead. FIGS. 1 and 5 show direct contact between the positive electrode on the positive battery terminal. The positive electrode also has electrical contact with first printed circuit elements (T1), on the substrate (53). From there, electricity flows distally, along one edge (54) of the substrate, down to a second printed circuit element (T2), where it passes into a heat generating portion (90). After exiting the heat generating portion, the current travels back toward the handle, along another edge (59) of the printed substrate, until it reaches third printed circuit element (T3). The current passes through an LED (55) and re-enters the printed substrate at fourth printed circuit element (T4). From there, the current travels to a first stationary contact (58). If the circuit is closed, current passes through sliding contact (57, see FIG. 1), to second stationary contact (56); along the printed substrate to fifth printed circuit elements (T5). From the fifth printed circuit terminal, electricity flows to negative electrode (52). From the negative electrode, the current passes into a negative battery lead (14, see FIG. 1), that extends into the handle (10) to reach the negative battery terminal (42), thus completing the circuit. If the circuit is opened, current cannot pass through sliding contact (57), to second stationary contact (56) and the circuit cannot be completed.

One advantage of the printed circuit is that virtually any electric circuit can be reproduced as a printed circuit of significantly smaller dimensions. Therefore, sophisticated circuits which are too bulky to implement in a heated applicator device may be implemented on the printed circuit strips as described herein. As discussed above, the ability to add heat generating capability to a cosmetic applicator without substantially increasing the size of the applicator is a great advantage. Furthermore, the printed circuit substrate (53) shown in FIG. 6 has a high percentage of unused space. This means that even more conducting elements could be printed on it as desired, without increasing the physical dimensions of the applicator. This is unlike a conventional wire conductor circuits that quickly use up the available space and which require a relatively high percentage of space to remain unused. Also, regardless of how complex the printed circuit becomes, final assembly of the present invention is not affected because all of the added complexity is confined to the printed circuit substrate. This is unlike conventional wire conductor circuits where each additional circuit element must be assembled during final assembly of the applicator into the housing. The printed circuits of the present invention can be manufactured well in advance of their final assembly into the applicator housing. For the most part, it is not possible with conventional wire conductor circuits to build the electronic circuit in advance of assembly into a housing, because the housing is needed to support the circuit and aid in making electrical connections.

Printed circuits offer additional advantages as well, like the possibility of implementing the present invention with no or relatively few individual wire conductors. All or most of the electronics may be confined to the printed circuit subassembly (50) and a customizable, modular heat generating portion (90). Also, the substrate (53) of the printed circuit strip may be substantially rigid or flexible. Herein lies another advantage of the present invention. A flexible circuit strip can be assembled into an interior space that is other than straight. For simplicity, the printed circuit strip may be manufactured in a straight or linear configuration, but the flexibility of the strip allows the strip to be used in applicator housings of various shapes. Also, even if the printed circuit strip reposes linearly within the assembled applicator, a flexible strip may facilitate assembly of the strip into the applicator housing.

With the advantages of the flexible, printed circuit and further, with the advantages of flexible heater technology, a heat generating separable applicator that is substantially no larger than a conventional separable applicator can now be fashioned. The cost of design, componentry and manufacture are minimal. In fact, the applicators of the present invention are less cumbersome and less complex that anything in the prior art that purports to do a similar job.

Variations for using a separable applicator according to the present invention are as follows. The applicator tip may be disposed in a reservoir of product with the electric circuit open, so that no heat is being generated. The applicator tip is then withdrawn from the reservoir and then the electric circuit is closed by operating the on-off switch. Within seconds of closing the circuit, heat is transferred to the product on the applicator tip, raising its temperature from an initial or ambient temperature toward a final or application temperature. Upon reaching the application temperature, perhaps receiving a signal from a temperature indication means, the user applies the product in an indicated or self-directed manner. Preferably, the user applies the product with the circuit closed, so that heat continues to warm the product during application, lest the product cool before application is completed. Thereafter, if more product is needed, the user may reinsert the applicator tip into the reservoir and retrieve more product. Substantial heating of the product in the reservoir may not occur because the applicator tip is only inserted or a short time. During application, at the user's discretion, the rate at which heat is generated may be adjusted, if such means (i.e. a rheostat) have been provided. The user may opt to do this if the user feels that the temperature is not optimal or if the time to reach application temperature is too long. When finished, the user may turn off the power before inserting the applicator tip into the reservoir or immediately thereafter. Either way, heating of the product in the reservoir is minimal and may cause no damage to the product in the reservoir.

Alternatively, the applicator tip may be disposed in a reservoir of product. The user may close the electric circuit by operating the on-off switch. Within seconds of closing the circuit, heat is transferred to the product on and near the applicator tip, raising its temperature from an initial or ambient temperature toward a final or application temperature. This technique is suitable for products that are not damaged by the heating applicator or that require several seconds, say, up to one minute, to reach application temperature. Upon reaching the application temperature, perhaps receiving a signal from a temperature indication means, the user withdraws the applicator from the reservoir and applies the product in an indicated manner. Preferably, the user applies the product with the circuit closed, so that heat continues to warm the product during application, lest the product cool before application is completed. Thereafter, if more product is needed, the user may reinsert the applicator tip into the reservoir and retrieve more product. If the product in the reservoir requires it, the heating applicator tip may again be allowed to dwell in the product, but this will likely be for less time than the first, since some warming has already occurred. During application, at the user's discretion, the rate at which heat is generated may be adjusted, if such means (i.e. a rheostat) have been provided. When finished, the user may turn off the power before inserting the applicator tip into the reservoir or immediately thereafter. Other scenarios for using an applicator as described herein, may exist, and these examples are not intended to be exhaustive.

What is claimed is:

1. A device for applying a personal care product, comprising: (a) an applicator and; (b) a product reservoir, wherein:

the applicator is separable from the product reservoir and comprises:

(i) a handle that is configured to house a current source;

(ii) means for opening and closing an electric circuit;

(iii) an applicator tip that comprises a working portion that is configured to convey product from the product reservoir to an application surface; and (iv) a printed circuit that comprises a heat generating portion and is capable of connecting to the current source, wherein the heat generating portion of the printed circuit is disposed inside the applicator tip;

the working portion of the applicator tip is capable of conducting heat from the heat generating portion of the printed circuit to product disposed on the outer surface of the working portion of the applicator tip; and disposal of the applicator tip in the product reservoir causes opening of the electric circuit and the electric circuit is capable of being closed only after the applicator tip is withdrawn from the product reservoir.

2. The device of claim 1 wherein the printed circuit comprises a flexible, non-conducting substrate and conducting elements supported by the substrate.

3. The device of claim 1, wherein the applicator further comprises a stem that connects the handle and the applicator tip.

4. The device of claim 3 wherein the stem is capable of attaching to and detaching from the product reservoir, and, when attached, is capable of forming an airtight and liquid tight seal with the product reservoir.

5. The device of claim 3 wherein the applicator tip is water-tight and the connection between the applicator tip and the stem is water-tight.

6. The device of claim 1 wherein the working portion is shaped for applying product to the eye area, the face, the arms or the legs.

7. The device of claim 1 wherein the working portion is textured to facilitate pick up and delivery of product.

8. The device of claim 7 wherein the applicator tip is flocked.

9. The device of claim 7 wherein the applicator tip is overlaid with an abrasive material or wherein the applicator tip is molded to have a raised pattern.

10. The device of claim 1 wherein the handle is opened at a first end, enabling the handle to receive the current source and to receive a proximal portion of the printed circuit.

11. The device of claim 1, wherein the current source is a power source.

12. The device of claim 11 wherein the power source comprises a DC power supply.

13. The device of claim 12 wherein the DC power supply is one or more lithium batteries.

14. The device of claim 1 wherein the heat generating portion of the printed circuit includes an etched foil resistive element.

15. The device of claim 1, wherein the personal care product is a product suitable for application to the eye area, lips, arms, or legs.

16. The device of claim 1, wherein the personal care product is a cosmetic product.

17. The device of claim 1, wherein when the electric circuit is closed the product disposed on the outer surface of the working portion of the applicator tip is heated to about 85° F. to about 120° F. in from less than 10 seconds to one minute.

18. The device of claim 1, wherein when the electric circuit is closed the product disposed on the outer surface of the working portion of the applicator tip is heated to about 95° F. in from less than 10 seconds to one minute.

19. The device of claim 1, wherein the applicator tip comprises a thermochromic material.

20. The device of claim 1 wherein the handle comprises an upper and a lower shell.

21. The device of claim 20 wherein the upper shell has a window, placed so that an indicator light housed in the shell, may shine through the window.

22. A device for applying a personal care product, comprising: (a) an applicator; and (b) a product reservoir, wherein:

the applicator is separable from the product reservoir and comprises:

(i) a handle that is configured to house a current source;

(ii) an on-off switch that is capable of opening and closing an electric circuit;

(iii) an applicator tip that comprises a working portion that is configured to convey product from the product reservoir to an application surface;

(iv) a printed circuit that comprises a heat generating portion and is capable of connecting to the current source, wherein the heat generating portion of the printed circuit is disposed inside the applicator tip; and (v) a stem that connects the handle and the applicator tip;

the working portion of the applicator tip is capable of conducting heat from the heat generating portion of the printed circuit to product disposed on the outer surface of the working portion of the applicator tip; and the on-off switch is configured such that the stem cannot be fully seated on the product reservoir while the switch is in an on position.

23. The device of claim 22 wherein the printed circuit comprises a flexible, non-conducting substrate and conducting elements supported by the substrate.

24. The device of claim 22 wherein the applicator tip is water-tight and the connection between the applicator tip and the stem is water-tight.

25. The device of claim 22 wherein the working portion is shaped for applying product to the eye area, the face, the arms or the legs.

26. The device of claim 22 wherein the working portion is textured to facilitate pick up and delivery of product.

27. The device of claim 26 wherein the applicator tip is flocked.

28. The device of claim 26 wherein the applicator tip is overlaid with an abrasive material or wherein the applicator tip is molded to have a raised pattern.

29. The device of claim 22 wherein the handle is opened at a first end, enabling the handle to receive the current source and to receive a proximal portion of the printed circuit.

30. The device of claim 22 wherein the handle comprises an upper and a lower shell.

31. The device of claim 30 wherein the upper shell has a window, placed so that an indicator light housed in the shell, may shine through the window.

32. The device of claim 22 wherein the current source is a power source.

33. The device of claim 32 wherein the power source comprises a DC power supply.

34. The device of claim 33 wherein the DC power supply is one or more lithium batteries.

35. The device of claim 22 wherein the heat generating portion of the printed circuit includes an etched foil resistive element.

36. The device of claim 22 wherein the stem is capable of attaching to and detaching from the product reservoir, and, when attached, is capable of forming an airtight and liquid tight seal with the product reservoir.

37. The device of claim 22 wherein the personal care product is a product suitable for application to the eye area, lips, arms, or legs.

38. The device of claim 22 wherein the personal care product is a cosmetic product.

39. The device of claim 22 wherein when the electric circuit is closed the product disposed on the outer surface of the working portion of the applicator tip is heated to about 85° F. to about 120° F. in from less than 10 seconds to one minute.

40. The device of claim 22 wherein when the electric circuit is closed the product disposed on the outer surface of the working portion of the applicator tip is heated to about 95° F. in from less than 10 seconds to one minute.

41. The device of claim 22 wherein the applicator tip comprises a thermochromic material.

* * * * *